United States Patent [19]

Doliner

[11] 4,438,697

[45] Mar. 27, 1984

[54] ROTARY SHEET PRINTING MACHINE

[75] Inventor: Herbert Doliner, Niederau, German Democratic Rep.

[73] Assignee: Veb Kombinat Polygraph "Werner Lamberz" Leipzig, Leipzig, German Democratic Rep.

[21] Appl. No.: 384,166

[22] Filed: Jun. 1, 1982

[30] Foreign Application Priority Data

Jun. 24, 1981 [DD] German Democratic Rep. ... 231096

[51] Int. Cl.[3] ..... B41F 7/06; B41F 13/00

[52] U.S. Cl. ..... 101/183; 101/216

[58] Field of Search ..... 101/183, 181, 176, 177, 101/178, 179, 180, 182, 184, 185, 248, 216, 219, 101/136, 137, 138, 139

[56] References Cited

U.S. PATENT DOCUMENTS

| | | | |
|---|---|---|---|
| 2,030,028 | 2/1936 | Greenwood | 101/248 X |
| 2,163,035 | 6/1939 | Grupe | 101/248 |
| 2,929,317 | 3/1960 | Baumgartner | 101/248 X |
| 4,207,815 | 6/1980 | Watanabe et al. | 101/181 X |

FOREIGN PATENT DOCUMENTS

| | | | |
|---|---|---|---|
| 2707035 | 8/1978 | Fed. Rep. of Germany | 101/183 |
| 2038717 | 7/1980 | United Kingdom | 101/183 |

*Primary Examiner*—J. Reed Fisher
*Attorney, Agent, or Firm*—Michael J. Striker

[57] ABSTRACT

A rotary sheet printing machine with a plurality of successively arranged printing mechanisms has a drive motor, a rotatable shaft extending between the printing mechanisms, a planetary transmission for each of the printing mechanisms and having a planetary gear carrier, and a worm gear transmission connecting the planetary gear carrier with a cylinder of each of the printing mechanisms.

6 Claims, 3 Drawing Figures

ROTARY SHEET PRINTING MACHINE

BACKGROUND OF THE INVENTION

The present invention relates to a rotary sheet printing machine having a plurality of printing mechanisms arranged in series. More particularly, it relates to a drive for such a rotary printing machine.

Rotary printing machines with a plurality of printing mechanisms arranged in series, as well as drives for such machines are known in the art, as disclosed for example in the German Democratic Republic patent No. 34,616. The printing mechanisms of this machine are connected with one another by a closed gear train and driven from a motor via a main drive shaft. The drive of each printing mechanism takes place via a planetary transmission for branching the power, a spur gear stage and a worm gear stage. This drive possesses the disadvantage in the fact that inavoidable tooth failures in the spur gear stage or bevel gear stage used instead of the spur gear stage worsen smooth running of these stages and result in double printing. High speeds developed by the machines increase this double printing. Simultaneously the noise development of the spur gear stage or the analogous bevel gear stage becomes higher with resulting noise loading of the operators.

SUMMARY OF THE INVENTION

Accordingly, it is an object of the present invention to provide a rotary sheet printing machine which avoids the disadvantages of the prior art.

More particularly, it is an object of the present invention to provide a rotary sheet printing machine which has such a drive that the quality of the printed product is improved because of the elimination of the doubling phenomenon with simultaneous decrease of expenditures for the drive and reduction of noise generation.

In keeping with these objects and with others which will become apparent hereinafter, one feature of the present invention resides in a rotary sheet printing machine in which a cylinder of each printing mechanism is connected with a main drive shaft via a power branching planetary transmission which has a planetay gear carrier connected by a worm gear means with a cylinder of the respective printing mechanism.

More particulary, each cylinder is connected with a worm gear member, whereas the planetay gear carrier has a worm member engaging with the worm gear member and formed hollow so that the shaft extends through the worm member.

When the rotary sheet printing machine, or more particularly its drive is designed in accordance with the present invention, the spur gear stages and/or bevel gear stages used in prior-art machines are dispensed with, which is very advantageous in the sense of manufacture and mounting of the drive of the printing machine.

In accordance with another advantageous feature of the present invention, the planetary transmission, the worm member and the worm gear member of each printing mechanism are accommodated in one drive housing.

Still a further advantageous feature of the present invention resides in the fact that the worm gear member is connected with the cylinder of a respective one of the printing mechanisms by an axially displaceable coupling pin.

Finally, a further advantageous feature of the present invention is that the worm gear member for each printing mechanism is composed of two separate parts including a toothed part engaging with the worm member, and a flange part associated with the toothed part.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
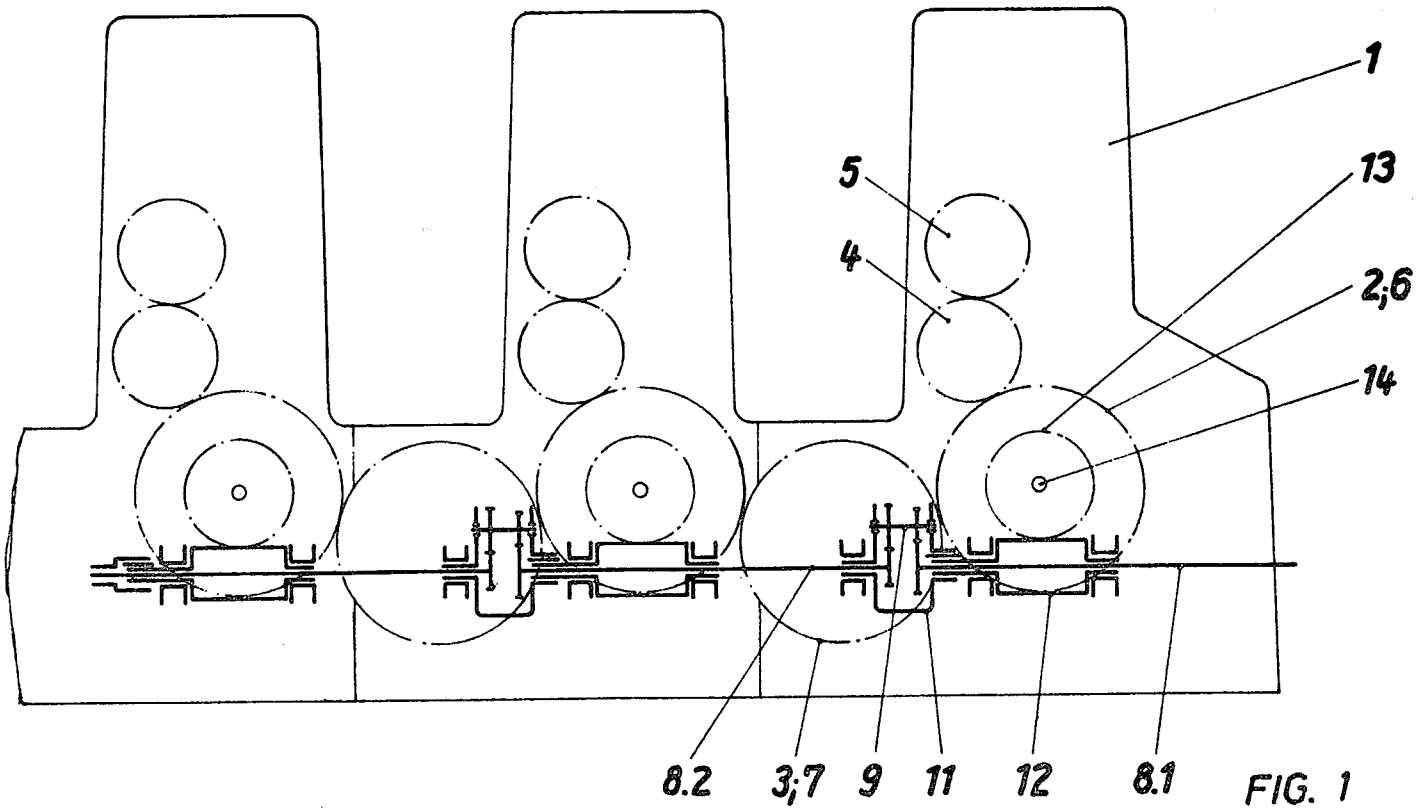
FIG. 1 is a view showing a drive of a rotary sheet printing machine with printing mechanisms arranged in series.

FIG. 1 schematically shows a rotary sheet printing machine with a drive in accordance with the present invention.

The printing machine has a plurality of printing mechanisms identified in toto with reference numeral 1 and arranged in series one behind the other. Each printing mechanism 1 has a printing cylinder 2, a transfer cylinder 3, an offset cylinder 4 and a printing cylinder 5. The printing cylinder 2 and the transfer cylinder 3 are provided with gears 6 and 7 respectively which engage with one another and form a closed gear train. The support of the gears of this gear train is performed in the respective printing mechanisms.

Power supply to the printing mechanisms takes place from a not shown motor via a drive shaft 8. The drive shaft 8 includes in the region of each printing mechanism a first shaft portion 8.1 which is connected with an inlet of a planetary transmission 9, and a second shaft portion 8.2 which is connected with the outlet of the same planetary transmission 9. The second shaft portion 8.2 executes connection to the neighboring printing mechanism which includes the above-mentioned elements.

Each planetary transmission 9 has a planetary gear carrier 11 provided with a worm member 12. This worm member 12 is hollow, and the first shaft portion 8.1 extends through the interior of the hollow worm member 12. The hollow worm member 12 engages with a worm gear member 13 which is in driving connection with the printing cylinder 2. The driving connection between the worm gear member 13 and the printing cylinder 2 of the respective printing mechanism is preformed via an axially displaceable coupling pin 14.

Figure 3:
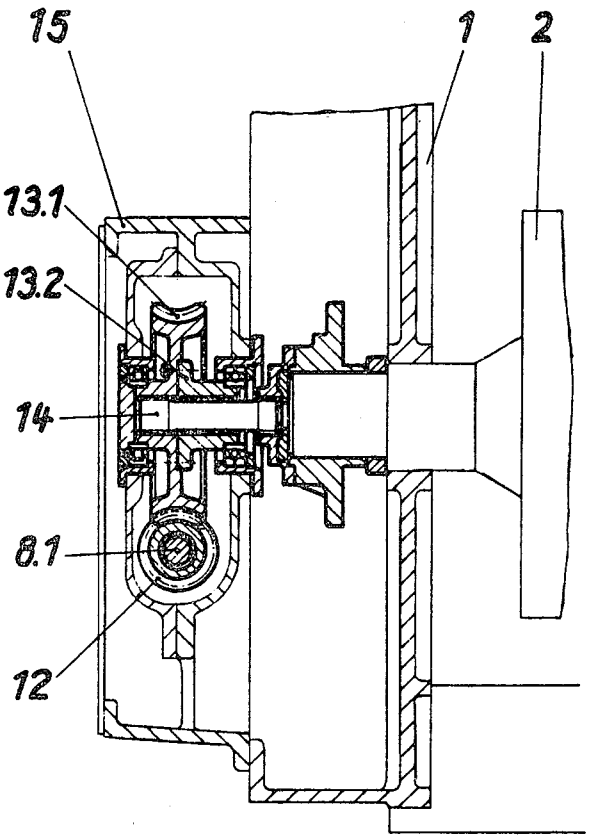
FIG. 3 is a view showing a section of a drive portion of FIG. 2.
Figure 2:
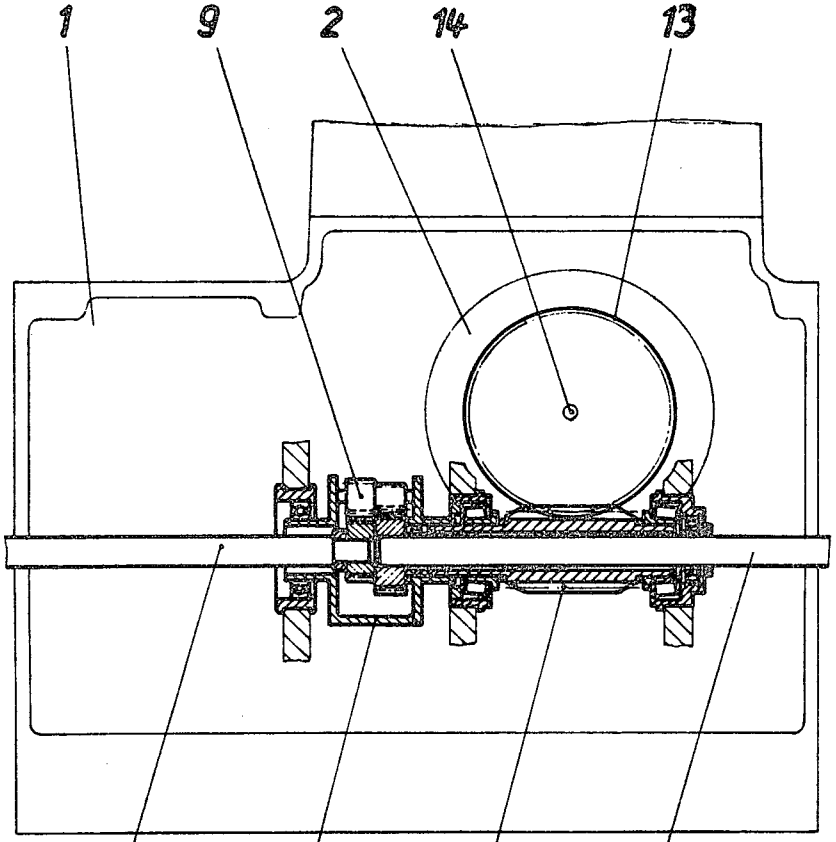
FIG. 2 is a lateral view showing a portion of the inventive drive for a respective one of the printing mechanisms.

FIGS. 2 and 3 more clearly illustrate the drive for each printing mechanism. The worm member 12 through which the first shaft portion 8.1 extends, the planetary transmission 1, and the worm gear member 13 are supported in a drive casing 15 which is separately mounted on the printing cylinder. The worm gear member 13 is composed of two separate parts including a toothed part 13.1 one-sidedly supported in the box-shaped drive casing 15, and a flange part 13.2 one-sidedly supported in this casing.

The operation of the above-described rotary sheet printing machine is performed in the following manner:

The entire power for the printing machine is supplied via the first shaft portion 8.1 to the respective planetary transmission 9. This power is branched in the planetary transmission 9. One part of the power determined by the gear ratio of the gears of the planetary transmission is supplied via the planetary gear carrier 11, the worm member 12, the worm gear member 13 and the coupling pin 14 to the printing cylinder of the first printing mechanism. The other part of the power is supplied via the second shaft portion 8.2 to the planetary transmission of the second printing mechanism, wherein again the power branching takes place in the above-described manner.

A pure torque is transmitted on the gears of the gear train 6, 7 between the printing cylinder 2 and the transfer cylinder 3. An axial force which takes place because of the connected in series gear stages in the prior-art drives is dispensed with. The force which is produced in the worm transmission 12, 13 is taken up by the casing 15 and, in condition of the axial displacement of the worm gear member 13 compensated by the coupling pin 14, does not provide any sources of disturbances for the running of the machine. The two-part construction of the worm gear member 13 including the toothed part 13.1 and the flange part 13.2 is very convenient for mounting the drive without complicated subdivision of the drive casing. For mounting the worm gear member 13, the toothed part 13.1 is brought to engagement with the worm member 12. After this, the toothed part 13.1 is turned about the center of the worm member 12 until the toothed part 13.1 abuts against the flange part 13.2. The above-mentioned parts are now connected with one another.

When the drive is designed in accordance with the present invention as separate structural groups to be mounted, they can be manufactured separately and installed separately into the machine. Simultaneously, the construction of the drive provides for a possibility to easily exchange the parts for repair, when needed.

It will be understood that each of the elements described above, or two or more together, may also find a useful application in other types of constructions differing from the types described above.

While the invention has been illustrated and described as embodied in a rotary sheet printing machine with a plurality of printing mechanisms, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteistics of the generic or specific aspects of the present invention.

What is claimed as new and desired to be protected by Letters Patent is set forth in the appended claims.

1. A rotary sheet-printing machine, comprising a plurality of printing mechanisms arranged successively in a longitudinal direction and each having a rotatable cylinder; rotary main drive means providing a predetermined power and having a rotatable main drive shaft extending through said printing mechanisms; and transmission means for transmitting rotation from said rotary drive means to said cylinders of said printing mechanisms, said transmission means including a planetary transmission for each of said printing mechanisms and having a planetary gear carrier, a hollow worm member driven by said shaft and fixedly connected with said planetary carrier so that said shaft extends through said worm member, and a worm gear connected with said cylinder without intermediate gear means and engaging with said worm member.

2. A rotary sheet-printing machine as defined in claim 1, wherein said shaft is composite has an inlet shaft portion and an outlet shaft portion in the region of each of said printing mechanisms, each of said planetary transmissions having further gear means connecting said inlet shaft portion with said outlet shaft portion.

3. A rotary sheet-printing machine as defined in claim 1, wherein each of said printing mechanisms further has at least one further cylinder; and further comprising additional gear means connecting said first-mentioned cylinder with said further cylinder of each of said printing mechanisms so as to form a gear train.

4. A rotary sheet-printing machine as defined in claim 1; and further comprising a plurality of box-shaped casings each accommodating said planetary transmission, said worm member and said worm gear member of a respective one of said printing mechanisms.

5. A rotary sheet-printing machine as defined in claim 4; and further comprising coupling means for connecting said worm gear member with said cylinder of each of said printing mechanisms and including an axially displaceable coupling pin.

6. A rotary sheet-printing machine as defined in claim 1, wherein said worm gear member is composed of two separate parts including a toothed part engaging with said worm member, and a flange part associated with said toothed part.

* * * * *